US006000782A

United States Patent [19]

Lee

[11] Patent Number: 6,000,782

[45] Date of Patent: Dec. 14, 1999

[54] INK-JET PRINTER HAVING MULTIPLE PRINTER HEADS AND RELATED PRINTING METHOD

[75] Inventor: Myoung Sool Lee, Kyonggi-do, Rep. of Korea

[73] Assignee: SamSung Electronics Co., Ltd., Kyungki-do, Rep. of Korea

[21] Appl. No.: 08/931,123

[22] Filed: Sep. 16, 1997

[30] Foreign Application Priority Data

Sep. 19, 1996 [KR] Rep. of Korea ..... 1996-40895

[51] Int. Cl.[6] ..... B41J 2/21; B41J 29/38; B41J 23/00

[52] U.S. Cl. ..... 347/43; 347/14; 347/37

[58] Field of Search ..... 347/43, 7, 14, 347/37; 346/139 D

[56] References Cited

U.S. PATENT DOCUMENTS

| | | | |
|---|---|---|---|
| 4,511,907 | 4/1985 | Fukuchi | 347/12 |
| 4,515,487 | 5/1985 | Minami | 347/43 |
| 4,516,139 | 5/1985 | Takiguchi | 347/15 |
| 4,680,596 | 7/1987 | Logan | 347/15 |
| 4,792,817 | 12/1988 | Barney | 347/4 |
| 4,864,328 | 9/1989 | Fischbeck | 347/43 |
| 4,999,651 | 3/1991 | Duffield et al. | 347/3 |
| 5,049,898 | 9/1991 | Arthur et al. | 347/19 |
| 5,268,767 | 12/1993 | Kurtin et al. | 347/3 |
| 5,297,017 | 3/1994 | Haselby et al. | 347/19 |
| 5,355,159 | 10/1994 | Kaneko | 347/9 |
| 5,488,397 | 1/1996 | Nguyen et al. | 347/40 |
| 5,587,730 | 12/1996 | Karz | 347/43 |
| 5,617,122 | 4/1997 | Numata et al. | 347/14 |
| 5,625,389 | 4/1997 | Eriksen | 347/41 |
| 5,742,306 | 4/1998 | Gompertz et al. | 347/43 |
| 5,777,634 | 7/1998 | Okamura et al. | 347/7 |

*Primary Examiner*—N. Le
*Assistant Examiner*—Thinh Nguyen
*Attorney, Agent, or Firm*—Robert E. Bushnell, Esq.

[57] ABSTRACT

A printing method of a color ink-jet printer having multiple printer heads provides the capability of printing regardless of the positions of the printer heads by adopting printing methods according to the mounting positions of the printer heads. The method includes a step for checking the types of the printer heads located at each port of the multiple printer heads; and a step for performing the printing operation by adjusting the printing positions of each printer head according to the types of the printer heads located at the printer head ports and the type of printing desired. According to the method, the printing operation is possible regardless of the positions of the black and white printer head and the color printer head. Moreover, when receiving data successively, as in a fax machine, the method prevents an error caused by the shortage of ink when processing data by providing an extra printer head at the printer head ports.

16 Claims, 5 Drawing Sheets

INK-JET PRINTER HAVING MULTIPLE PRINTER HEADS AND RELATED PRINTING METHOD

CLAIM OF PRIORITY

This application makes reference to, incorporates the same herein, and claims all benefits accruing under 35 U.S.C. §119 from an application for PRINTING METHOD OF AN INK-JET PRINTER HAVING MULTIPLE PRINTER HEADS earlier filed in the Korean Industrial Property Office on Sep. 19, 1996 and there duly assigned Serial No. 40895/1996.

BACKGROUND OF THE INVENTION

Technical Field

The present invention relates to a an inkjet printer having multiple printer heads and a related printing method, and particularly to an improved printing method for an inkjet printer having multiple printer heads. The printer is capable of printing regardless of the positions of the printer heads by adopting printing methods according to the mounting positions of the printer heads.

Related Art

In the case of the ink-jet printer using conventional multiple printer heads, the types of printer heads which are located at two printer head ports (A and B) are designated by the manufacturer of the printer. When the location of the printer head is not properly arranged, a printing operation is impossible. Accordingly, since the printer head should be properly adjusted at a predetermined position in order to function properly, a user should confirm the position of the printer head when using the printer so that adjustments can be made when the position of the printer head is not arranged well. Moreover, there is a problem in that the manufacturer of the printer should, but often does not, display the position of the printer head to the user.

The following patents are representative of the prior art discussed above, and have the disadvantages listed above and below: U.S. Pat. No. 5,625,389 to Eriksen et al., entitled Ink-Jet Print Head Array And Interlace Method, U.S. Pat. No. 5,488,397 to Nguyen et al., entitled Wide-Swath Printer/Plotter Using Multiple Printheads, U.S. Pat. No. 5,297,017 to Haselby et al., entitled Print Cartridge Alignment In Paper Axis, U.S. Pat. No. 5,268,767 to Kurtin et al, entitled Image Pattern For Facsimile Receiver With Reciprocating Printhead And Method, U.S. Pat. No. 4,999,651 to Duffield et al., entitled Multi-Color Recorder With Plural Ink Jets And Reservoirs Co-Mounted On A Reciprocating Carriage, Each Reservoir Containing A Sub-Reservoir In Communication With An Ink Supply Conduit, U.S. Pat. No. 4,864,328 to Fischbeck, entitled Dual Mode Ink Jet Printer, U.S. Pat. No. 4,792,817 to Barney, entitled Ink Jet Printing Systems, U.S. Pat. No. 4,680,596 to Logan, entitled Method And Apparatus For Controlling Ink-Jet Color Printing Heads, U.S. Pat. No. 4,516,139 to Takiguchi, entitled Print Control System In Color Image Printer, U.S. Pat. No. 4,515,487 to Minami, entitled Multicolor Printer, and U.S. Pat. No. 4,511,907 to Fukuchi, entitled Color Ink-Jet Printer.

While each of the above-listed patents disclose features in common with the present invention, none of them teaches or suggests the specifically recited printing method for an ink jet printer having multiple printheads, which is capable of printing regardless of the positions of the printer heads by adopting printing methods according to the mounting positions of the printer heads as in the present invention.

SUMMARY OF THE INVENTION

Therefore, it is an object of the present invention to provide a printing method for an ink-jet printer having multiple printer heads and a related printing method, wherein the printer is capable of printing regardless of the positions of the printer heads and the printer head ports. Such an object is accomplished by adopting printing methods according to the mounting positions of the printer heads.

To achieve the above-mentioned object, a printing method for an ink-jet printer having multiple printer heads includes the step of checking the types of printer heads located at each port of the printer, and the additional step of performing the printing operation by adjusting the printing positions of each printer head according to the types of printer heads located at the printer head ports.

BRIEF DESCRIPTION OF THE DRAWINGS

The above object and advantages of the present invention will be more clearly understood from the following detailed description taken in conjunction with the accompanying drawings, in which.

DETAILED DESCRIPTION OF THE PREFERRED EMBODIMENTS

The objects, characteristics and advantages of the above-described invention will be more clearly understood through the preferable embodiments referring to the attached drawings.

Figure 1:
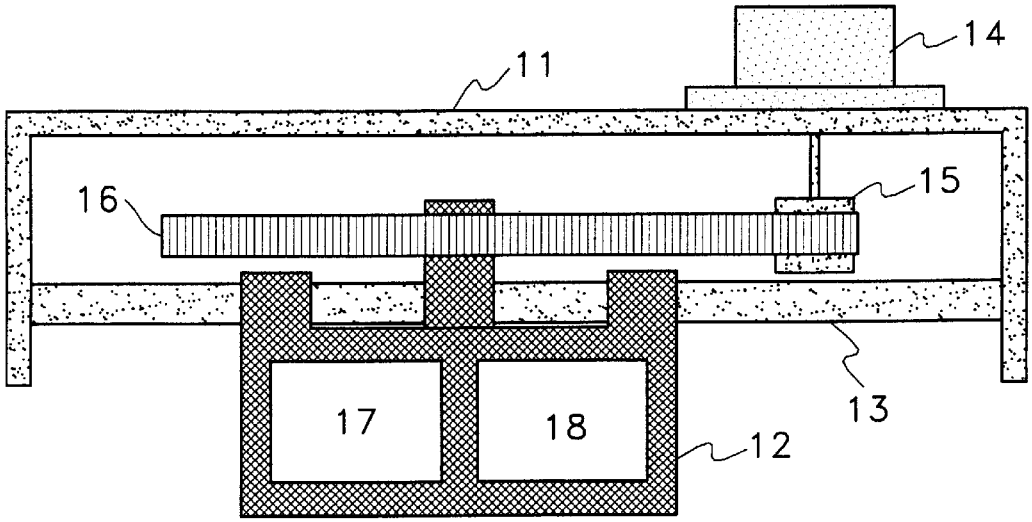
FIG. 1 (Prior Art)
FIG. 1 is a sectional view showing a carrier system of an ink-jet printer having conventional multiple printer heads.

As shown in FIG. 1, a carrier system of an ink-jet printer having conventional multiple printer heads includes a main frame 11 which envelops a carrier system; a carrier body 12 which contains and moves the printer heads; a carrier shaft 13 which acts as a rail for moving the carrier body 12; a carrier motor 14 which provides the power for moving the carrier body 12; a drive pulley 15 which transmits the power provided by the carrier motor 14; a timing belt 16 which transfers the power of drive pulley 15 to the carrier body 12; and a printer head port 17 and a printer head port 18, each of which contains a printer head in the carrier body 12.

Figure 2:
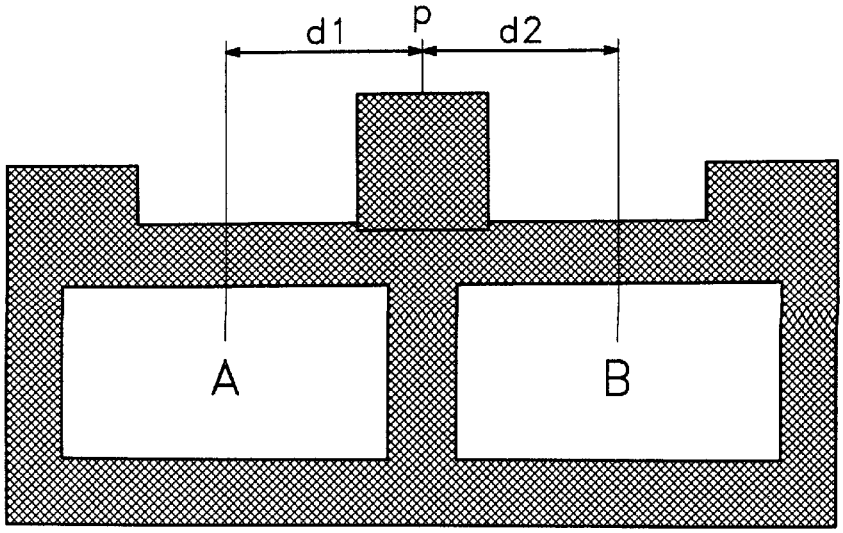
FIG. 2 is a sectional view showing the relative positions of a carrier body and a printer head to set the printing position of the printer head according to the present invention.

FIG. 2 is a sectional view showing the relative positions of a carrier body and a printer head to set the printing position of the printer head according to the present invention. The view of FIG. 2 includes a standard printing position P indicating a printing position sensed by a central processing unit of the printer system; d1indicating the distance between the standard printing position P and a nozzle of the printer head A located at the printer head port 17; and d2 indicating the distance between the standard printing position P and a nozzle of the printer head B located at the printer head port 18.

Figure 3:
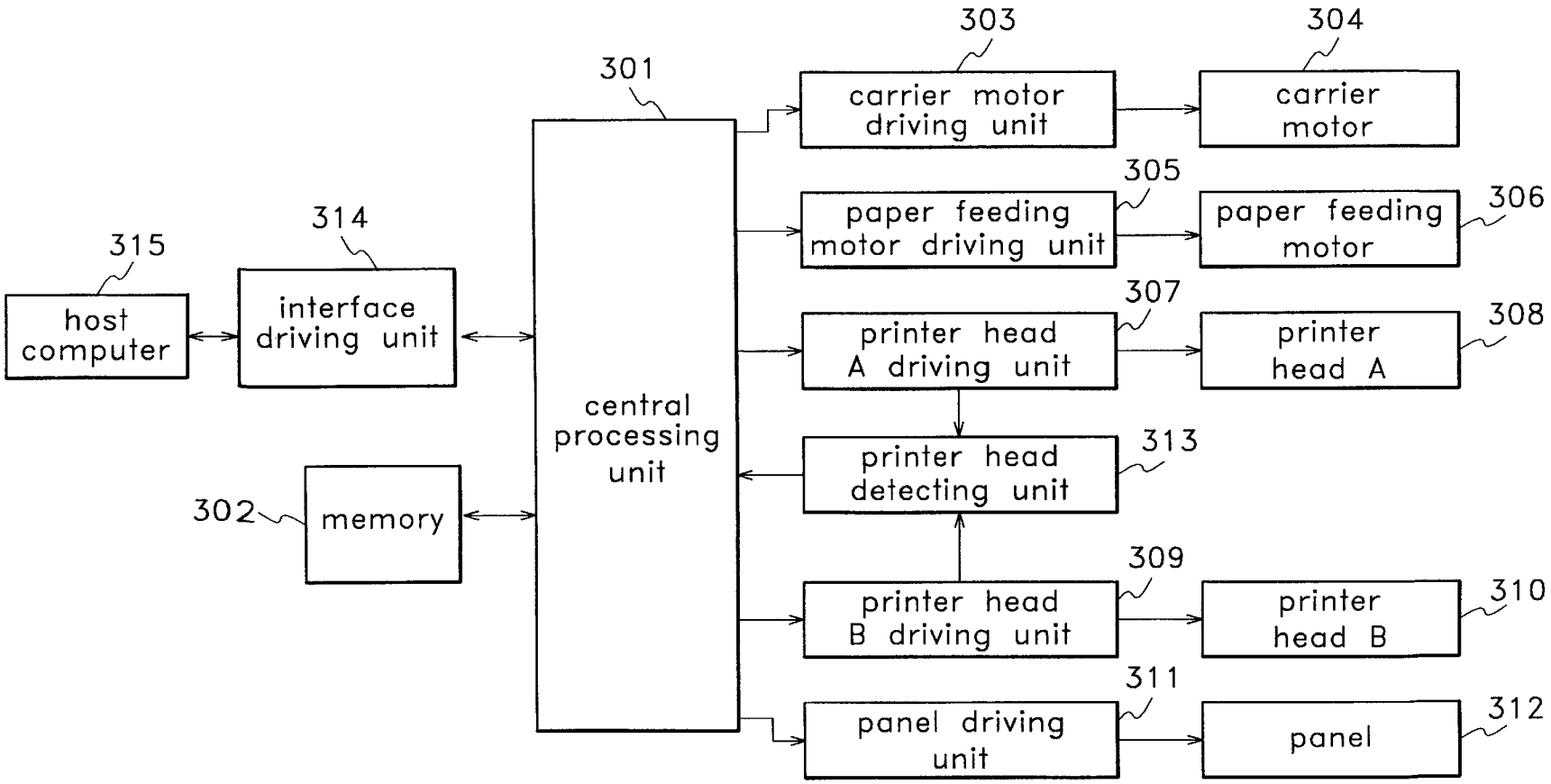
FIG. 3 (Prior Art)
FIG. 3 is a block diagram showing a driving circuit of the conventional printer.

FIG. 3 is a block diagram showing a driving circuit of the conventional printer. As shown in FIG. 3, the driving circuit of the conventional printer includes a host computer 315 connected to a printer; an interface driving unit 314 for interfacing the host computer 315 and the printer; a memory 302 for receiving printing data from the host computer and storing that data; a central processing unit 301 which is connected both to the interface driving unit 314 and to the memory 302, and which controls the printer; a carrier motor driving unit 303 which is controlled by the central processing unit 301 regarding movement of the carrier body; a carrier motor 304 which is mechanically operated by the carrier motor driving unit 303; a paper feeding motor driving unit 305 which is controlled by the central processing unit 301 regarding movement of the paper; a paper feeding motor 306 which is mechanically operated by the paper feeding motor driving unit 305; a printer head A driving unit 307 which is controlled by the central processing unit 301 for printing; a printer head A 308 for performing a printing operation under the control of the printer head A driving unit 307; a printer head B driving unit 309 which is controlled by the central processing unit 301 for printing; a printer head B 310 for performing a printing operation under the control of the printer head B driving unit 309; a panel driving unit 311 which is controlled by the central processing unit 301 for operating a panel 312 of the printer; a panel 312 which is operated by the panel driving unit 311; and a printer head detecting unit 313 for detecting whether or not the printer heads are located, and for detecting the remaining amount of ink for the printer head.

The operation of the printer having the conventional printer driving circuit is as follows. The central processing unit 301 receives data for printing from the host computer 315 and stores the data in memory 302. The data are converted into data which are capable of driving the printer mechanism. Accordingly, a printing operation is performed by driving the carrier motor driving unit 303, the paper feeding driving unit 305, the printer head A driving unit 307, and the printer head B driving unit 309.

Figure 4:
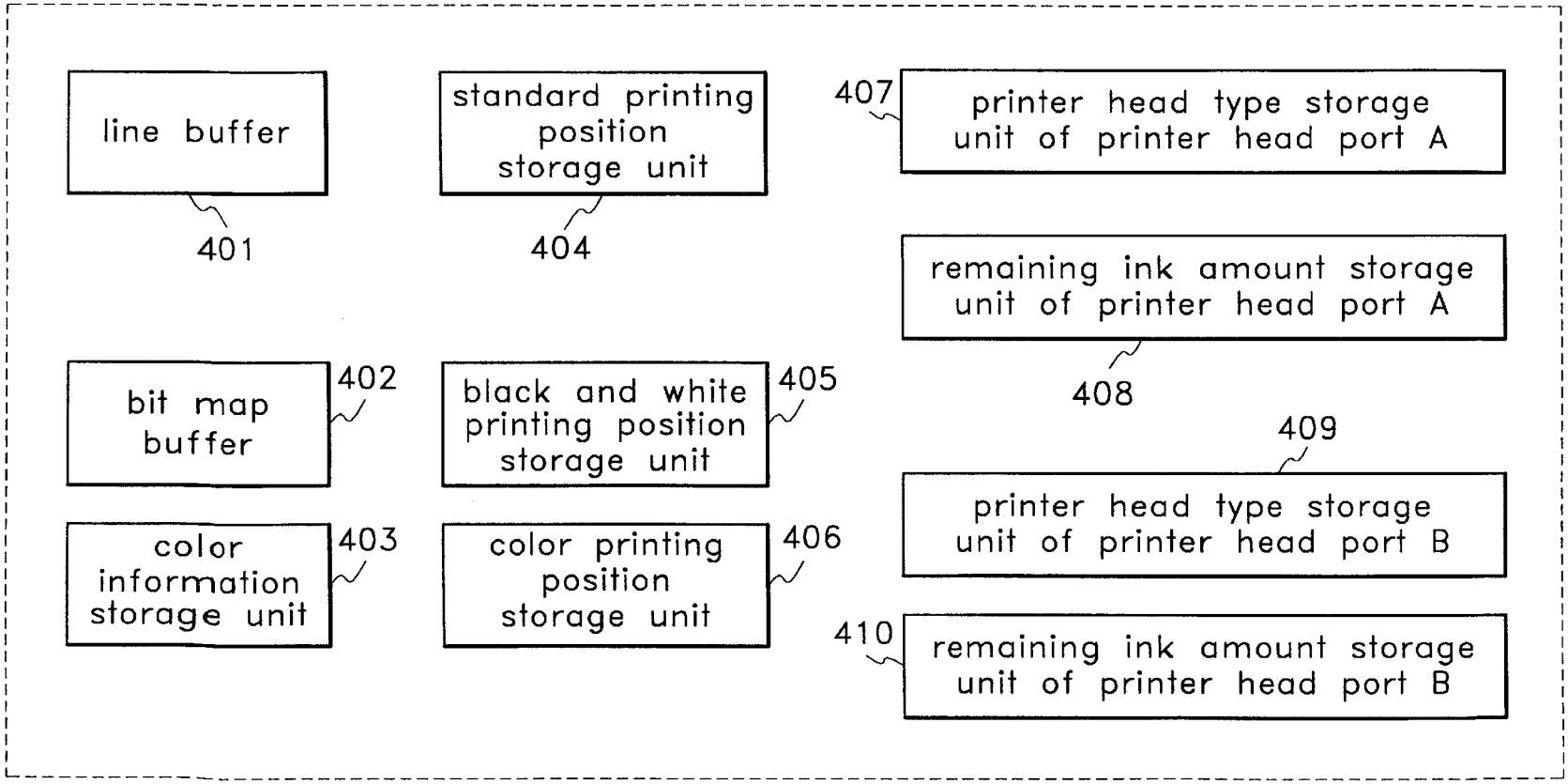
FIG. 4 is a block diagram showing the construction of a memory according to the present invention.

FIG. 4 is a block diagram showing the construction of a memory according to the present invention. As shown in FIG. 4, the memory according to the present invention includes a line buffer 401 which stores data inputted from the host computer 315; a bit map buffer 402 which stores data converted into an image capable of printing the data stored in the line buffer 401; a color information storage unit 403 which stores color information relative to the image; a standard printing position storage unit 404 which stores information about the position where the data are printed; a black and white printing position storage unit 405 and a color printing position storage unit 406 which store information about the printing position of the data, the printing position being calculated in order that the printer head, which will be actually driven, is adjusted from the standard printing position P, the printing position being calculated according to the type of printing data by using the distances d1 and d2 between the nozzles of each printer head and the standard printing position P; a printer head type storage unit 407 of printer head port A which stores the type of printer head located at the printer head port A as detected by the printer head detector 313; a remaining ink amount storage unit 408 of the printer head port A which stores the remaining ink amount in the printer head port A; a printer head type storage unit 409 of the printer head port B which stores the type of printer head located at the printer head port B as detected by the printer head detector 313; and a remaining ink amount storage unit 410 of the printer head port B which stores the remaining ink amount in the printer head port B.

Figure 5A:
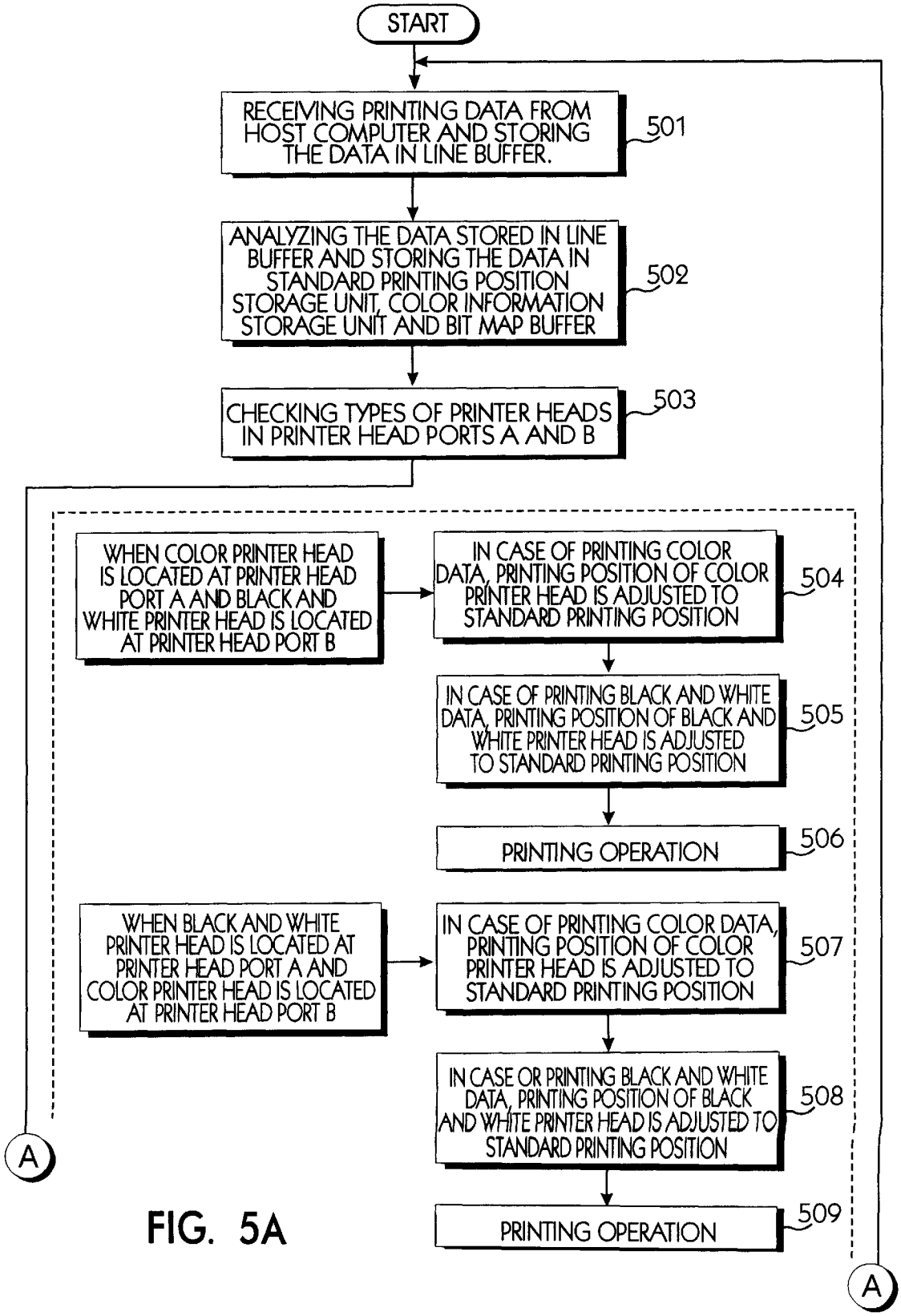
FIGS. 5A and 5B are flowcharts showing the printing method of an ink-jet printer having multiple printer heads according to the present invention.
Figure 5B:
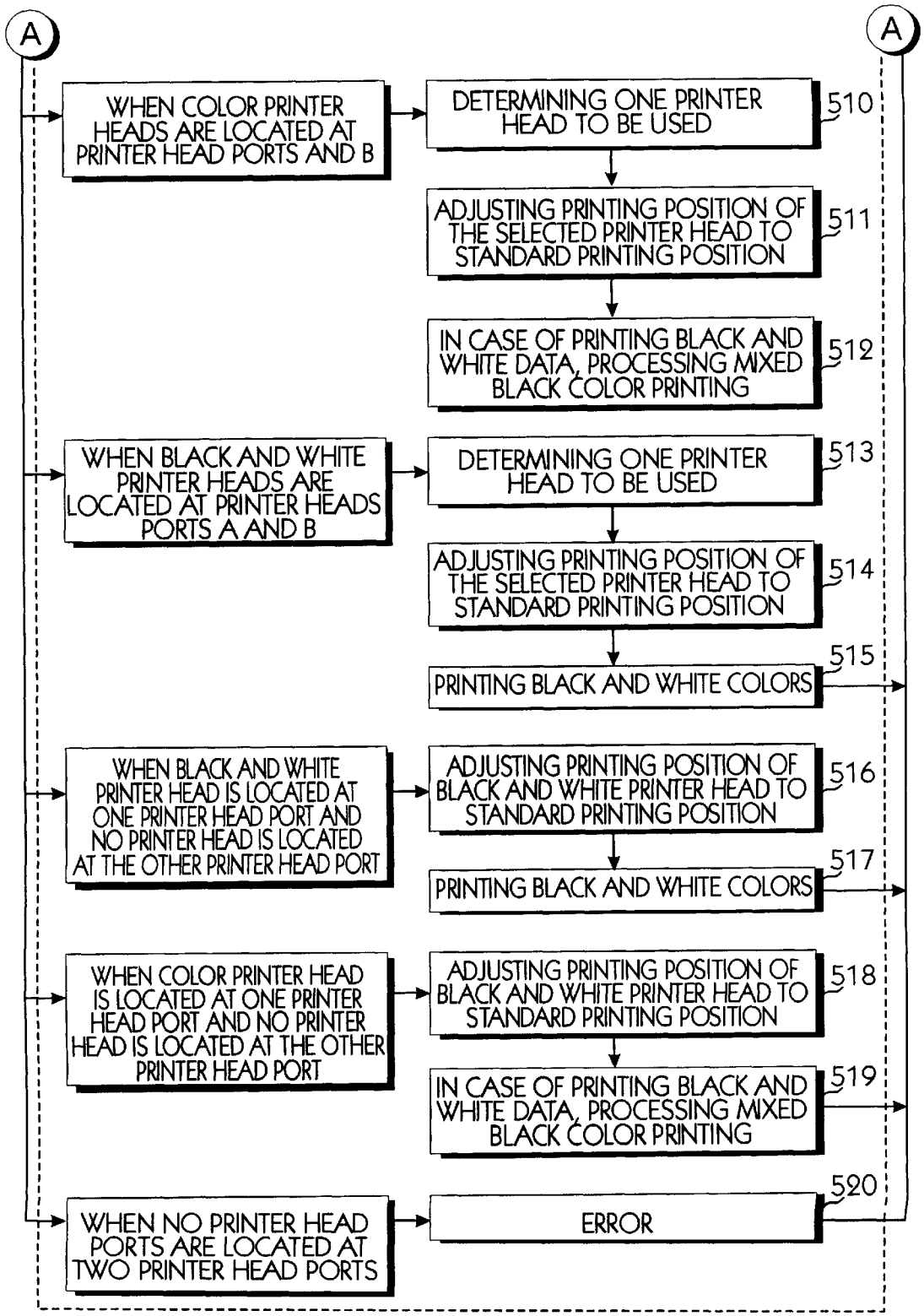

FIGS. 5A and 5B are flowcharts showing the printing method of the ink-jet printer having multiple printer heads according to the present invention. As shown in the drawing, the method includes a step for receiving data from the host computer 315 and storing the data in the line buffer 401 of the memory; a step for analyzing the data of the line buffer 401 and storing the color information of the data in the color information storage unit 403; a step for storing the standard printing position of the data in the standard printing position storage unit 404 of the memory; a step for storing the data, after conversion into an image capable of printing, in the bit map buffer 402; a step for checking the type of printer head located at the printer head ports A and B; and a step S1 for performing the printing operation by adjusting the printing position of each printer head according to the types of printer heads located at the printer head ports A and B.

The step S1 for performing the printing operation by adjusting the printing position of each printer head according to the type of printer head located at the printer head ports A and B further includes a step for adjusting the printing position of the color printer head to the standard printing position P when printing color data, in the case where the color printer head is located at one printer head port and the black and white printer head is located at the other printer head port; a step for adjusting the printing position of the black and white printer head to the standard printing position P in the case of printing black and white data; and a step for performing the printing operation by using the adjusted value of the printing position of the printer head.

The step S1 for performing the printing operation by adjusting the printing position of each printer head according to the types of printer heads located at the printer head ports further includes a step for determining one printer head to be used by checking the remaining ink amount of each printer head located at the printer head ports, in the case where the same type of printer head is located at one printer head port and at the other printer head port; a step for adjusting the printing position of the determined printer head to the standard printing position P; and a step for performing the printing operation by using the adjusted value of the printing position of the printer head.

Moreover, the step S1 for performing the printing operation by adjusting the printing position of each printer head according to the types of printer heads located at the printer head ports further includes a step for adjusting the printing position ofthe printer head to the standard printing position P, in the case where the printer head is located at one printer head port and the other printer head is not located at the other printer head port; and a step for performing the printing operation by using the adjusted value of the printing position of the printer head.

The operation of the printing method of the ink-jet printer using multiple printer heads according to the present invention is illustrated in detail.

First, a step 501 is performed to receive printing data from the host computer 315 and to store the data in the line buffer 401. Then, a step 502 is performed to store the information on the standard printing position, the color, and the information on data converted into an image capable of printing, in the standard printing position storage unit 404, in the color information storage unit 403, and in the bit map buffer 412, respectively. After checking the type of printer heads located at the printer head ports A and B and the remaining ink amount of the printer heads located at each of the printer head ports A and B, the information on the type of each printer head is stored in the printer head type storage unit 407 of printer head port A and in the printer head type storage unit 409 of the printer head port B. After that, the information on the remaining ink amount of each printer head port is stored in the remaining ink amount storage unit 408 of the printer head port A and in the remaining ink amount storage unit 410 of the printer head port B. (Step 503) Continuously, step S1 is performed for printing by adjusting the printing positions of each printer head, according to the types of printer heads located at printer head ports, by using the information of the memory formed by the step 503.

Here, when the color printer head is located at the printer head port A 17 and the black and white printer head is located at the printer head port B 18, a step 504 is performed in the case of printing color data for adjusting the printing position of the color printer head to the standard printing position P by shifting the position of the carrier body 12 in the rightward direction by as much as d1 from the standard printing position P. Moreover, in the case of printing black and white data, a step 505 is performed to adjust the printing position of the black and white printer head to the standard printing position P by shifting the position value of the carrier body 12 in the leftward direction by as much as d2from the standard printing position. That is, when the position value increases as the carrier body 12 moves to the left on the main frame 11 and decreases as the carrier body 12 moves to the right, the printing position of the color data is indicated as Pc=standard printing position P−d1, and it is stored in the color printing position storage unit 406 of the memory. The printing position of the black and white data is indicated as Pm=standard printing position P+d2, and it is stored in the black and white printing position storage unit 405 of the memory. A step 506 is performed to print by using the stored value of the printing position.

When the black and white printer head is located at the printer head port A 17 and the color printer head is located at the printer head port B 18, in the case of printing color data, a step 507 is performed to adjust the printing position value of the color printer head to the standard printing position P by shifting the position value of the carrier body 12 in the leftward direction by as much as d2from the standard printing position P. In the case of printing the black and white data, a step 508 is performed to adjust the printing position value of the black and white printer head to the standard printing position P by shifting the position value of the carrier body 12 in the rightward direction by as much as d1from the standard printing position P. That is, when the position value increases as the carrier body 12 moves to the left on the main frame 11 and decreases as the carrier body 12 moves to the right, the printing position of the color data is indicated as Pc=standard printing position P+d2, and it is stored in the color printing position storage unit 406 of the memory. The printing position of the black and white data is indicated as Pm=standard printing position P−d1, and it is stored in the black and white printing position storage unit 405 of the memory. A step 509 is performed to print by using the stored value of the printing position.

In the case where color printer heads are located at both the printer head port A 17 and the printer head port B 18, a step 510 is performed to determine one printer head to be used by checking the remaining ink amount in each printer head located at each printer head port. At this time, the printer head having a small amount of ink is used. Step 511 is performed to calculate the value of the printing position in compliance with the determined printer head, using the aforesaid method. Here, in the case of printing the black and white data, a step 512 is performed to process the mixed black color printing.

In the case where black and white printer heads are located at both the printer head port A 17 and the printer head port B 18, step 513 is performed to determine one printer head to be used by checking the remaining ink amount in each printer head located at each printer head port. At this time, the printer head having a small amount of ink is used. A step 514 is performed to calculate the printing position value in compliance with the determined printer head, using the aforesaid method. Step 515 is performed to print the black and white colors.

In the case where the black and white printer head is located at one printer head port and no printer head is located at the other printer head port, a step 516 is performed to calculate the printing position value by adjusting to the black and white printer head. For example, when the black and white printer head is located at the printer head port A, the printing position value of the black and white printer head is adjusted to the standard printing position P by shifting the position value of the carrier body 12 in the rightward direction by as much as d1from the standard printing position P. That is, providing that the position value of the carrier body 12 increases as the carrier body 12 moves to the left on the main frame 11, and that the position value decreases as the carrier body 12 moves to the right on the main frame 11, the printing position of the black and white data is calculated by using Pm=standard printing position P−d1, and it is stored in the black and white printing position storage unit 405 of the memory. After that, a step 517 is performed to print the black and white data by using the printing position stored as above.

In the case where the color printer head is located at the one printer head port and no printer head is located at the other printer head port, a step 518 is performed to calculate the printing position by adjusting to the color printer head. For example, when the color printer head is not located at the printer head port A, the printing position value of the color printer head is adjusted to the standard printing position P by shifting the printing value of the carrier body 12 in the rightward direction by as much as d1from the standard printing position P. Assuming that the position of the carrier body 12 increases as the carrier body 12 moves to the left on the main frame 11 and the position decreases as the carrier body is moved to the right on the main frame 11, the printing position of the color data is calculated by using Pc=standard printing position P−d1. After that, it is stored in the color printing position storage unit 406 of the memory, and a step 519 is performed for printing the color data using the stored printing position.

In the case where no printer head is located at either of the printer head ports, a step 520 is performed to issue an error signal.

As described above, according to the printing method of ink-jet printer having multiple printer heads, the printing operation is possible regardless of the positions of the black and white printer head and the color printer head. Moreover, when receiving data successively, as in a fax machine, it has the effect of preventing an error caused by the shortage of ink when processing data by providing an extra printer head at the printer head port A 17 or the printer head port B 18.

While there have been illustrated and described what are considered to be preferred embodiments of the present invention, it will be understood by those skilled in the art that various changes and modifications may be made, and equivalents may be substituted for elements thereof without departing from the true scope ofthe present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiment falling within the scope of the appended claims.

What is claimed is:

1. A printing method of an ink-jet printer having first and second printer heads and first and second printer head ports in a carrier body, comprising the steps of:

determining that the same type of printer head is located at each of the printer head ports;

selecting one printer head of each of said first and second printer heads;

adjusting a printing position at the printer head port corresponding to the selected one printer head; and performing the printing operation at the printer head port corresponding to the selected one printer head to be used;

wherein said selecting step comprises selecting a printer head having a smallest amount of remaining ink.

2. The method of claim 1, wherein said adjusting step comprises adjusting a printing position of a color printer head prior to printing color data, and, alternatively, adjusting a printing position of a black and white printer head prior to printing black and white data; and wherein said performing step comprises performing the printing operation by using the adjusted printing position of the selected one printer head.

3. The method of claim 1, wherein said performing step comprises performing the printing operation by using the adjusted printing position of the selected one printer head.

4. The method of claims 1, wherein the step of adjusting the printing position at the printer head port corresponding to the seected one printer head comprises shifting a position of said carrier body by an amount at least equal to a distance from a standard printing position to a nozzle of the selected one printer head.

5. The method of claim 1, wherein, in said adjusting step, an error signal is generated in the case where no printer head is located at any of the multiple printer head ports.

6. The method of claim 1, wherein said adjusting step comprises adjusting the printing position at the printer head port corresponding to the selected one printer head to a standard printing position.

7. The method of claim 1, wherein said performing step comprises processing mixed black color printing when a color print head is located at each of the printer head ports and when black and white data are to be printed.

8. The method of claim 1, wherein said performing step comprises processing mixed black color printing when a color print head is located at one printer head port and no printer head is located at another printer head port and when black and white data are to be printed.

9. An inkjet printer, comprising:

a carrier body;

first and second printer heads and first and second printer head ports carried by said carrier body;

determining means for determining that the same type of printer head is located at each of the printer head ports;

selecting means for selecting one printer head of said first and second printer heads;

adjusting means for adjusting a printing position at the printer head port corresponding to the selected one printer head; and printing means for carrying out the printing operation at the printer head port corresponding to the selected one printer head to be used;

wherein said selecting means selects a printer head having the smallest amount of remaining ink.

10. The printer of claim 9, wherein said printing means performs the printing operation by using the adjusted printing position of the printer head port corresponding to the selected one printer head.

11. The printer of claim 9, wherein said printing means performs the printing operation by using the adjusted printing position of the selected one printer head.

12. The printer of claim 9, wherein said adjusting means adjusts the printing position at the printer head port corresponding to the selected one printer head by shifting a position of said carrier body by an amount of at least equal to a distance from a standard printing position to a nozzle of the selected one printer head.

13. The printer of claim 9, further comprising error signal generating means for generating an error signal in the case where no printer head is located at any of said printer head ports.

14. The printer of claim 9, wherein said adjusting means adjusts the printing position at the printer head port corresponding to the selected one printer head to a standard printing position.

15. The printer of claim 9, wherein said printing means processes mixed black color printing when a color print head is located at each of the printer head ports and when black and white data are to be printed.

16. The printer of claim 9, wherein said printing means processes mixed black color printing when a color print head is located at one printer head port and no printer head is located at another printer head port and when black and white data are to be printed.

* * * * *